US005297533A

United States Patent [19]

Cook

[11] Patent Number: 5,297,533

[45] Date of Patent: Mar. 29, 1994

[54] LIGHT HOLDER AND STABILIZER ATTACHMENT FOR BOW

[76] Inventor: Virgil Cook, 337 Nob North Dr., Cohutta, Ga. 30710

[21] Appl. No.: 995,188

[22] Filed: Dec. 22, 1992

[51] Int. Cl.[5] ..... F41B 5/00

[52] U.S. Cl. ..... 124/88; 124/23.1

[58] Field of Search ..... 124/87, 88, 89, 23.1

[56] References Cited

U.S. PATENT DOCUMENTS 3,739,167 6/1973 Avery ..... 124/88

4,640,258 2/1987 Penney ..... 124/89

FOREIGN PATENT DOCUMENTS 521449 7/1976 U.S.S.R. ..... 124/88

*Primary Examiner*—Randolph A. Reese

*Assistant Examiner*—Anthony Knight

*Attorney, Agent, or Firm*—Jones & Askew

[57] ABSTRACT

An attachment for a hunting bow designed to be screwed into a threaded receptacle normally provided for a stabilizer. The attachment includes an elongated cylinder with an open end and a substantially circular rear plate, from which a threaded shaft extends rearwardly. An annular cylinder of compressible and deformable material is inserted within the elongated cylinder to hold a flashlight inserted therein. A spacer is preferably provided between the threaded shaft and the end plate on the cylinder. When attached to the stabilizer receptacle on a conventional hunting bow, the apparatus both holds a light and also provides a conventional stabilizer function.

22 Claims, 3 Drawing Sheets

LIGHT HOLDER AND STABILIZER ATTACHMENT FOR BOW

TECHNICAL FIELD

The present invention relates to accessories for use with bows by bow hunters and in particular is an apparatus particularly designed to place a stabilizer on a compound hunting bow that provides illumination of the target.

BACKGROUND OF THE INVENTION

Bow hunting has evolved over the last several centuries from one of the principle food gathering activities of many groups of indigenous Americans to a sport that is normally practiced for relaxation, companionship, and the opportunity to experience the hunting tradition of the human species. While firearms can deliver a higher velocity high mass projectile over a longer range than a bow, many sportsmen continue hunting with the bow and arrow, finding that it is more satisfying than otherwise similar hunting with firearms. Many sportsmen consider it truly more sporting to bring down a game animal with bow and arrow than with a high powered rifle or high mass slug from a shot gun.

While bow hunters hunt with a variety of bows, most modern bows fall into one of the categories of compound, recurve, or long bow. The present invention was particularly designed to be used with modern hunting compound bows, although it is usable with any bow that includes either original equipment or add-on apparatus for holding a stabilizer thereon. Thus, while its use is not so limited, it was originally conceived as an attachment for use with a modern hunting compound bow.

As is known to bow hunters and those skilled in the art of bow design, a stabilizer attachment for a modern compound bow is a relatively massive elongated attachment that normally screws into a threaded fitting on the front of the bow's riser. Ideally, the longitudinal axis of the stabilizer is parallel to the line of travel of an arrow as it is propelled by the bow string or cable toward the target. Most stabilizers have a concentrated mass at the end distal from the bow riser. The stabilizer adds additional mass extended away from the riser gripping hand of the shooter, and thus tends to alleviate the shooter's tendency to rotate the bow about the center of force within the grip when the bow is drawn. It thus helps to stabilize the bow during aiming. Furthermore, the stabilizer adds inertia to the bow that reduces the tendency of the shooter to rotate the bow in a vertical plane when the arrow is released. Thus, the stabilizer assists in preventing movement of the bow as the bow string or cable propels the arrow from the bow and the arrow is still in contact therewith.

The motivation for the present invention was the inventor's need for a light to assist in illuminating predatory animals in the dark. It is well known to hunters that the hunting of game animals at night with the assistance of lamps and the like is illegal. Deer, for example, will tend to freeze or remain in a particular position when confronted with a bright source of light at night. However, there is no such restriction under laws regulating hunting in the United States against using an illumination device to attack predatory animals. There are many circumstances in which such an apparatus is both useful and desirable.

Many animals that prey on domesticated livestock and pets are nocturnal predators. For example, farmers in the east are well acquainted with problems of foxes attacking chickens at night. In the west, it is common to find livestock such as sheep or calves susceptible to attacks by wolves or coyotes. Many circumstances of ranching or farming make it much more desirable to hunt such animals in order to protect one's livestock using a bow rather than a firearm. The report from a firearm can startle many animals as well as human neighbors. Furthermore, if multiple predators are in the same vicinity, the report of a firearm will often scare off the remaining animals who are not under immediate attack, whereas the relative silence of a bow has neither of these drawbacks. Therefore, it is often desirable to be able to bow hunt a nocturnal predator in order to protect one's livestock, domestic pets, or even to protect human residents in non-urban areas.

When hunting a predator at night, it is very desirable to be able to maintain the predator/target in a constant state of illumination. This is for reasons both of not losing track of the target's location, but also for the possible benefit of freezing the target. While one can carry a bow with a nocked arrow, there is no practical way to maintain the illumination of the target while assuming an appropriate position for firing, extending the bow and drawing back the string or cable for firing. There are existing devices that include a battery operated lamp formed with a headband for wearing on the head, to achieve an illumination effect not unlike that of a miner's helmet. These devices are relatively heavy, tend to be uncomfortable, and can interfere with proper drawing back of the bow string. Bow shooters know that proper shooting requires the bow riser to be held at the end of a fully extended arm with the string or cable drawn back so that nock and fletching of the arrow is held next to the shooter's chin. For relatively bulky head mounted lamps, the cable or string can come in contact with the lamp interfering with the shooter's comfort. Additionally, such a shooting arrangement of necessity requires the bow to be interposed in the path of illumination between a head worn lamp and the target.

It is the need of a simple and effective way of illuminating a target for a bow hunter in the dark that led to the creation of the present invention. During the course of attacking the problem of how to make such a device, the present inventor discovered a way of combining the illumination function with the more traditional stabilizer function, thus leading to an extremely useful device for hunting predatory animals in the dark.

SUMMARY OF THE PRESENT INVENTION

The present invention provides an attachment for holding a flashlight extended from the front face of a bow that includes a hollow receptacle of a cross sectional shape suited to accept the cross sectional shape of a flashlight. It includes apparatus for mating the light holder to a standard receptacle for a bow stabilizer, which receptacle is conventionally included on the riser of a compound hunting bow. In its preferred form, the present invention includes an elongated cylinder open at one end and closed at the other by a substantially circular plate. The cylinder has a characteristic longitudinal axis. Behind the plate enclosing one end, a threaded shaft is located that is coaxial with the longitudinal axis of the cylinder. The shaft has a diameter and pitch of the threads to match the standard pitch for the female threaded receptacle on a bow riser.

Additionally, the cylinder is lined with a compressible and deformable material for snugly gripping the flashlight when it is inserted into the cylinder. The pressure from the compressed material both holds the flashlight in place and holds the compressible material snugly journaled within the interior of the cylinder so that the flashlight stays in place even if the bow is moved or held in a downward facing position, as a bow often is when a hunter is walking.

In its preferred forms, a spacer is included between the rear plate that encloses one end of the cylinder and the shaft, which spacer assists in reducing the tendency of the apparatus to mar the riser face when the apparatus is snugly screwed onto the bow during use.

By maintaining the axis of the threaded shaft in a relationship that is substantially coaxial with the cylinder's axis, the shaft is substantially coaxial with the longitudinal axis of the flashlight and thus, its output beam. Since the conventional threaded receptacle on the riser of the bow is positioned to hold the stabilizer closely adjacent and parallel to the path of the arrow as it is shot from the bow, this structural characteristic assures that the flashlight, when inserted in the apparatus, will illuminate the area at which the arrow is pointing as the user draws the cable and prepares to shoot.

Preferably the apparatus is made from a unitary milled piece of aluminum. It can also be constructed using two parts plus a conventional bolt. Other structures including molded plastic are possible but not preferred.

The most preferred form of the present invention is specifically designed to hold a model of a particular commercially available flashlight made by the Mag Instrument Corporation of Ontario, Calif. This light is of a construction that is heavier than many conventional plastic flashlights. The combination of the mass of the flashlight structure and two size C batteries that are normally included therein cause the flashlight to serve a stabilizing function very similar to a conventional stabilizer when used in connection with the apparatus of the present invention on a bow. The inventor believes the use of one of the above described particular commercial products constitutes the best mode of using the present invention. However, the present invention is usable with virtually any flashlight. Thus, it will be apparent that in addition to other cylindrical configurations of the present invention for use with other lights, equivalent embodiments with the non-cylindrical configuration may be constructed for use with non-cylindrical flashlights. Thus, the present invention not only provides for dependable illumination of a target along the axis of the shot to be made, it also allows the flashlight to serve the function of a stabilizer for the bow when in use. Of course, other flashlights may be used and the mass normally associated with storage batteries, either disposable or rechargeable, provides the stabilizing function.

It is therefore an object of the present invention to provide an apparatus that may be easily attached to conventional hunting bows for illuminating a target.

It is a further object to provide such an apparatus that will dependably hold a light, does not require uncomfortable or heavy apparatus to be worm about the head, nor does it require the user to employ one of his or her hands for separately carrying a light.

It is a further object of the present invention to provide a simple and inexpensive apparatus that may be easily attached to a bow for illuminating predatory animals or other targets while shooting at night.

It is still a further object of the present invention to provide a bow attachment that serves the dual function of providing target illumination and stabilization of the bow while being shot.

That the present invention meets these objects, and fulfills the above described need from the prior art will be appreciated by the detailed description of two alternate embodiments hereinbelow.

DETAILED DESCRIPTION

Figure 1:
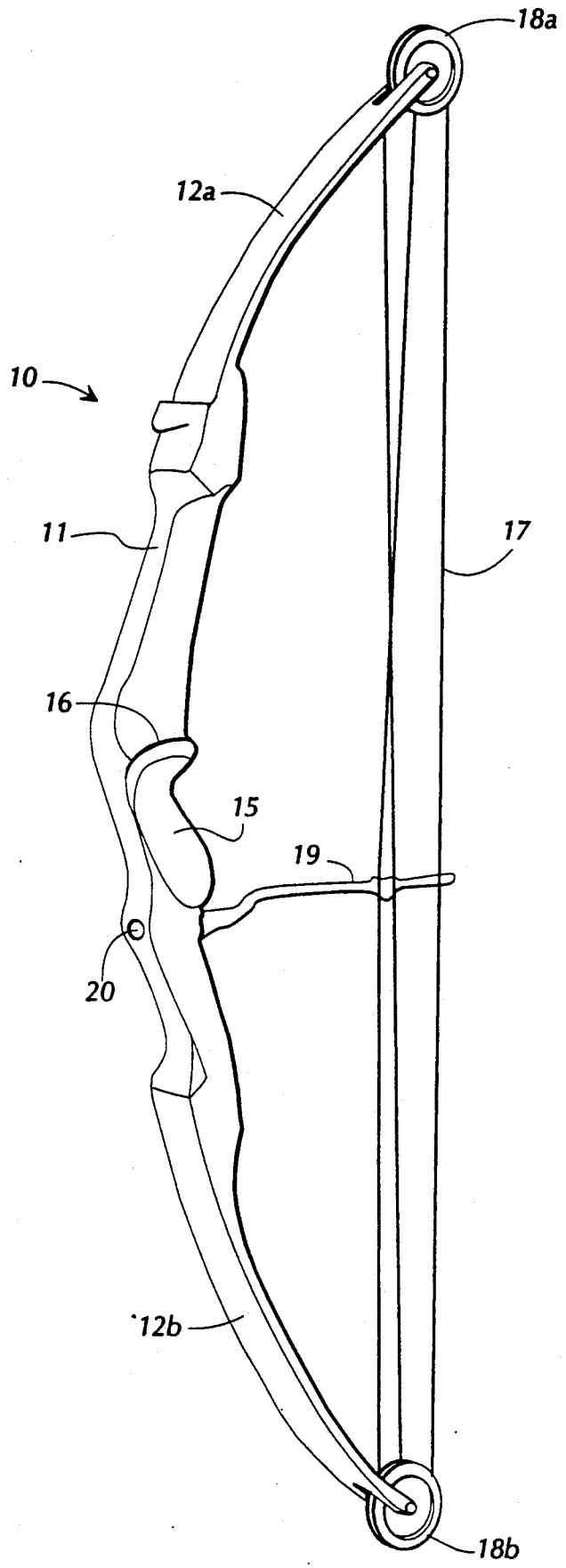
FIG. 1 is a pictorial view of a conventional compound hunting bow with which the present invention may be used.

Turning now to the drawing figures in which like numerals represent like parts, the preferred embodiments of the present invention will now be described. FIG. 1 shows a conventional modern compound hunting bow generally indicated at 10. The bow includes a riser section 11 to which flexible limbs 12*a* and 12*b* are attached. The limbs are members that are flexible under torsion with a high value of a spring constant. They are generally made out of some combination of wood or fiberglass laminant or solid fiberglass. The flexing of the limbs as the arrow is drawn back toward a shooting position stores the energy for propelling the arrow. The user holds the bow by grip 15 and places an arrow on shelf 16, the nock of which is urged against cable 17. Cable 17 is a multiple strand apparatus, two free ends of which are secured to limbs 12*a* and 12*b*. Cable 17 is wrapped about a pulley system that includes wheels 18*a* and 18*b*. As is well known to users of compound bows, as the arrow is drawn back by the shooter pulling cable 17, limbs 12 flex. The geometry of pulleys 18*a* and 18*b* are such that there is a point at which the force acting on the arrow effectively goes over center and it does not require a force equal to the full pull weight of the bow to be applied in order to maintain the arrow in the position ready for shooting. A cable guard 19 is also shown on the bow of FIG. 1.

A threaded metal receptacle 20 is disposed on the front of the riser so that its top opening is flush with the face of the riser at the point at which it is inserted. In most compound hunting bows sold in America, this receptacle is threaded to accept a 5/16 inch bolt with a thread pitch of 24 threads per inch. As noted hereinabove, this threaded receptacle on the front face of riser 11 is included by the manufacturer of the bow for attaching a stabilizer.

Figure 2:
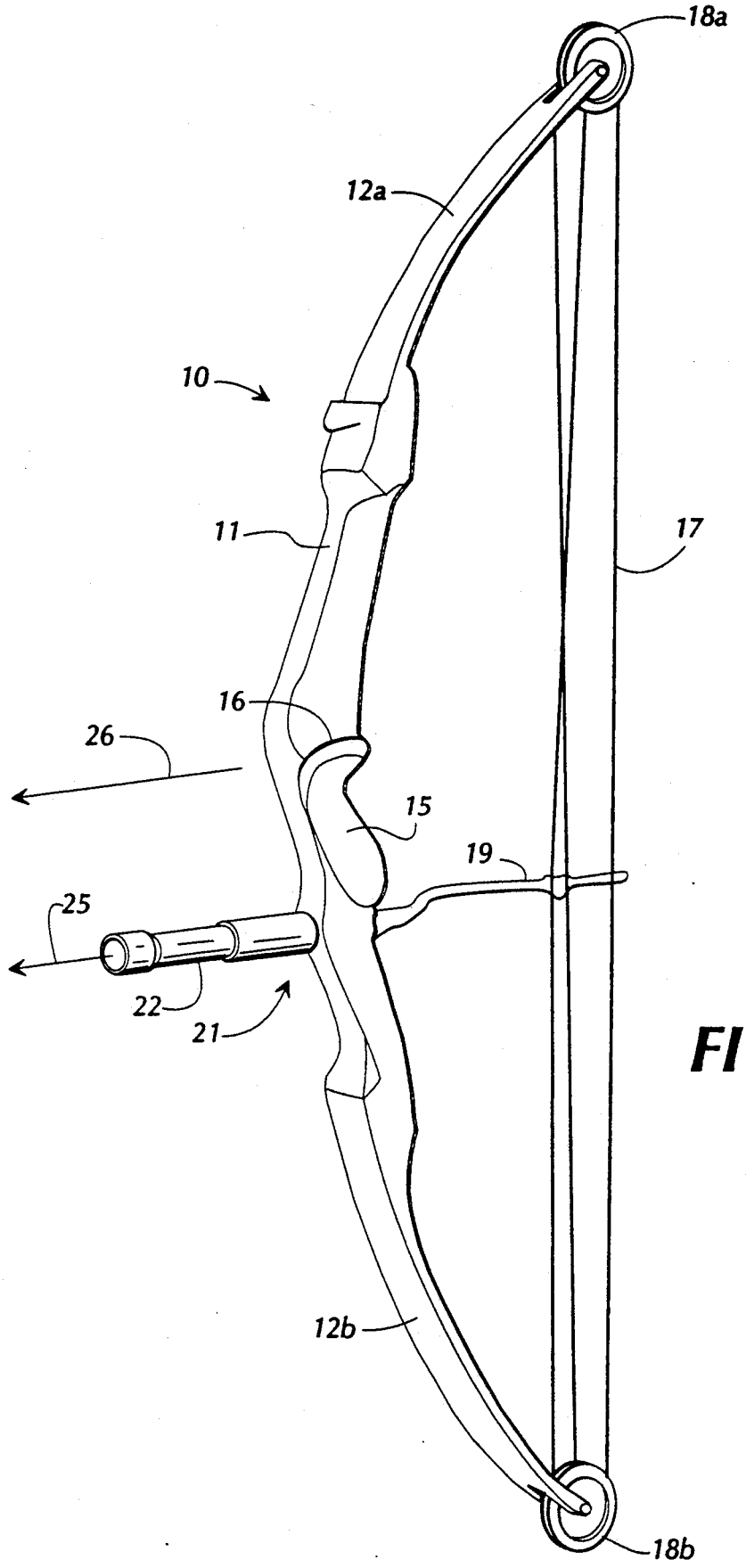
FIG. 2 is a pictorial view of the bow of FIG. 1 with the present invention attached and a flashlight inserted therein, depicting the arrangement for the normally contemplated use of the present invention.

FIG. 2 shows the bow illustrated in FIG. 1 with an embodiment of the present invention, generally indicated at 21, attached with a flashlight 22 inserted therein. The longitudinal axis of flashlight 22 is indicated at 25. Similarly, the line of flight of an arrow (not shown) as it is shot from the bow atop shelf 16 is indicated at 26 in FIG. 2.

As can be seen in FIG. 2, the central axis 25 of the beam of flashlight 22 is parallel to, and proximate the line of flight 26 of an arrow as it exists bow 10.

Figure 3:
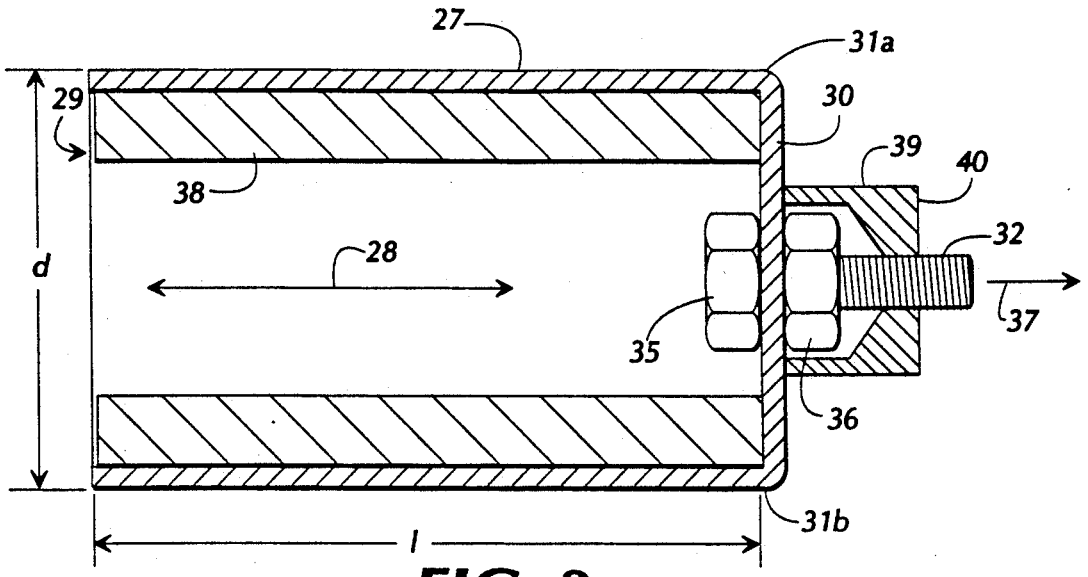
FIG. 3 is a side elevational view in cross section of a first preferred embodiment of the present invention.
Figure 4A:
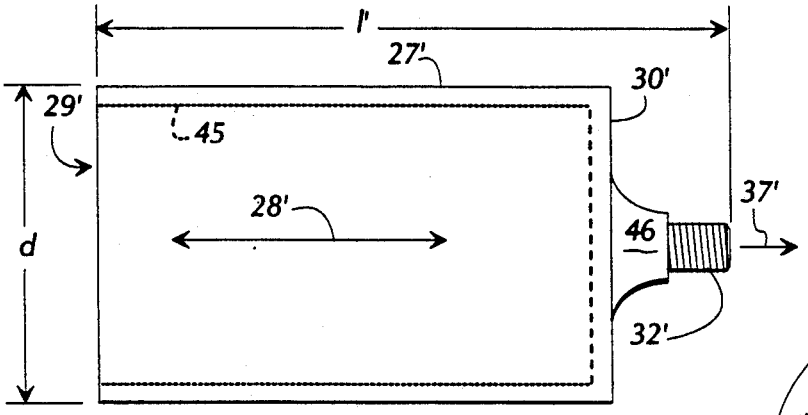
FIG. 4A is a side elevational view of a second preferred embodiment of the present invention.
Figure 4B:
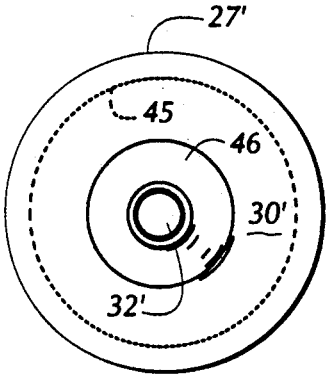
FIG. 4B is a rear elevational view of the second preferred embodiment.
Figure 5:
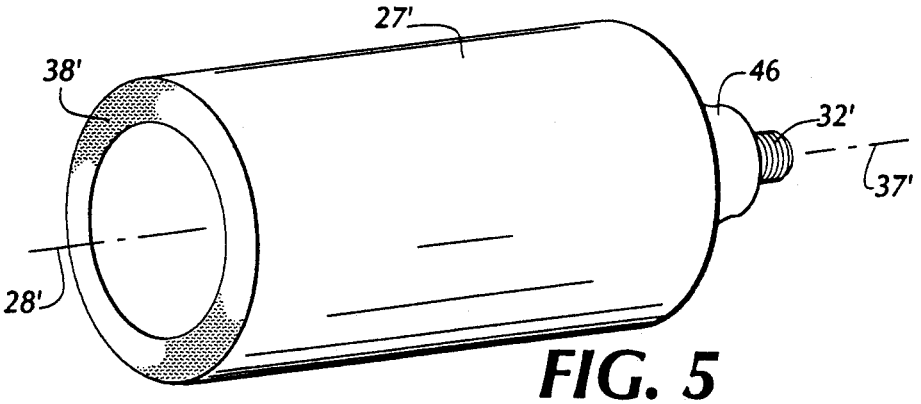
FIG. 5 is a pictorial view of the second preferred embodiment with the deformable flashlight holding apparatus inserted therein.

Details of two exemplary embodiments of the present invention are shown in FIGS. 3-5. FIG. 3 shows the first embodiment in cross section with the bolt and shaft shown in elevation. The embodiment includes an elongated cylinder 27 having a characteristic longitudinal axis 28. A front end, indicated at 29, is open and the rear end is closed by a substantially circular plate 30. In the preferred embodiment, circular plate 30 is spot welded at points 31*a* and 31*b* to elongated cylinder 27. A threaded shaft 32 is formed by the threaded shank of a bolt, the head of which is indicated at 35 in the drawing. A nut 36 secures the bolt to circular plate 30. In the preferred embodiment, the bolt comprising shaft 32 is a one inch long hex bolt with shaft 32 being of 5/16 inch diameter threaded at 24 threads per inch. It therefore is designed to mate with threaded receptacle 20 (FIG. 1) on a bow. Of course, other thread and shaft diameters could be employed could connect to different receptacles on other bows. A longitudinal shaft axis 37 is the central axis of threaded shaft 32. As may be seen from inspection of FIG. 3, shaft axis 37 and longitudinal axis 28 of cylinder 27 are substantially coaxial. The preferred embodiment is made of aluminum and is preferably painted or coated in some fashion with a dark non-reflective coating to keep the apparatus from reflecting moonlight and the like when in use.

Inserted within elongated cylinder 27 is an annular cylinder 38 of a compressible and deformable material. In the preferred embodiment, common foam pipe insulation is used. It is believed that same is a form of synthetic foam rubber such as a polyurethane foam. However, natural and synthetic foam rubber and similar materials including latex foam rubber and the like may be used. The important characteristic is that same be deformable and compressible in a manner such that when a flashlight is inserted thereinto, it will securely grip the light as well as have the outer wall of annular cylinder 38 urged against the inner wall of elongated cylinder 27 to hold the combination of the annular foam cylinder and the flashlight in place.

A plastic spacer 39 is preferably disposed behind circular plate 30. While it can loosely fit, it is preferable to have the hole through which shaft 32 passes be sized so that the threads of shaft 32 will at least keep spacer 39 from falling off. As may be appreciated from inspection of FIGS. 2 and 3 together, spacer 39 provides a plastic face, indicated at 40, that will contact the front face of bow riser 11 (FIG. 2) when shaft 32 is inserted into receptacle 20 (FIG. 1) and tightened down. This helps prevent the marring and scratching of the front face of riser 11.

The elongated cylinder of the first preferred embodiment has a length indicated as 1 and a diameter indicated as d. In the first preferred embodiment, 1 is equal is to 3-½ inches and d is 2 inches. It is preferable that elongated cylinder 27 be constructed from 2 inch outside diameter 0.083 inch wall tubular aluminum. Circular end plate 30 is constructed of aluminum of a similar thickness.

An alternate preferred embodiment is illustrated in FIGS. 4A, 4B and 5. FIG. 4A shows a side elevation of the alternate preferred embodiment. This is an embodiment wherein the metallic parts of the apparatus are made from a unitary single piece of cast aluminum. The elongated cylinder, indicated at 27′ is formed at the outer wall of the unitary aluminum piece, with the inner wall being illustrated in phantom at 45. The substantially circular end plate 30′ is formed from the same piece as elongated cylinder 27′. This apparatus also features open end 29′. The cylinder 27′ likewise has a longitudinal axis 28′.

The spacer function in the second preferred embodiment is formed by a tapered cylindrical structure 46 from which shaft 32′ extends. As may be seen from viewing FIGS. 4A and 4B together, spacer 46 is shaped so as to have circular cross sections in planes perpendicular to longitudinal axis 28′. Shaft 32′ is formed integrally with cylinder 27′, plate 30′ and spacer 32. It is preferably threaded in a separate machining step after formation of the other structures. Its shaft axis 37′ is substantially coaxial with longitudinal axis 28′ and is likewise threaded to mate with receptacle 20 (FIG. 1). The annular deformable light holding apparatus illustrated in FIG. 3 is omitted in FIG. 4A. When using the second preferred embodiment, it may desirable to insert a washer of nylon, or some other non-abrasive material, over shaft 32′ to prevent the rear face of spacer 46 from marring or scratching the front of riser 11 (FIG. 1).

FIG. 5 shows a pictorial view of the second preferred embodiment with its slightly longer annular cylinder for holding the flashlight inserted into the interior of cylinder 27′. It is used in the same way as the first preferred embodiment.

The second preferred embodiment has an overall length 1′ between open end 29 and the distal end of shaft 32′ of 4⅜ inches. Like the first preferred embodiment, the outside diameter of cylinder 27′, shown as d in FIG. 4A, is 2 inches.

The dimensions for the preferred embodiment are given to accommodate the commercial Maglight flashlight product of the type powered by two standard C cells. In view of the disclosure herein, it will be apparent to those skilled in the art how to construct other embodiments of the present invention for holding other types of flashlights or including those manufactured by the Mag Instrument Corporation powered by D cells and AA cells, as well as flashlights made by other manufacturers. While such embodiments are clearly within the scope of the present invention, the inventor believes that the second preferred embodiment illustrated in FIGS. 4 and 5 constitutes the best mode of practicing the present invention and that the commercial Maglight product powered by two C cells is the best combination of illumination and stabilizing function.

In use, a hunter stalking a predator animal at night can approach in the dark if desired. Alternatively, the hunter may nock an arrow and place it on shelf 16, holding it with his or her index finger in a normal manner. The flashlight inserted into the embodiment of the present invention may then be operated by pushing its on/off switch button which, on the Maglight products, extends beyond open ends 29 and 29′ of the illustrated embodiments. This allows the hunter to use the light to illuminate the area where he or she is searching for the target animal. It will be readily apparent that the user can use the flashlight to selectively illuminate different areas being searched while keeping the fingers of the right hand on the cable in a position preparing to rapidly draw the arrow back to a shooting position.

Given the foregoing disclosure of the preferred embodiment and design parameters for the present invention, other embodiments of the present invention will suggest themselves to those skilled in the art. Therefore, the scope of the present invention is to be limited only by the claims below.

What is claimed is:

1. An attachment for a bow of the type having a threaded receptacle on a front face thereof comprising in combination:

an elongated cylinder having a characteristic longitudinal axis, an open front end, and a rear end closed by a substantially circular plate disposed substantially perpendicular to said longitudinal axis;

a shaft connected to said substantially circular plate and extending away from said rear end of said elongated cylinder having a characteristic shaft axis that is substantially coaxial with said longitudinal axis of said cylinder, said shaft being threaded to mate with said threaded receptacle; and annular deformable light holding means for supporting a cylindrical light, said light holding means being journaled within said cylinder.

2. An attachment for a bow as recited in claim 1 further comprising spacer means positioned behind said substantially circular plate and through which said shaft axis passes for holding said substantially circular plate away from said front face of said bow when said shaft is mated to said threaded receptacle.

3. An attachment for a bow as recited in claim 1 wherein said annular deformable light holding means comprises an annular cylinder of a material that is both compressible and deformable.

4. An attachment for a bow as recited in claim 1 wherein said annular deformable light holding means comprises an annular cylinder of foam rubber.

5. An attachment for a bow as recited in claim 4 wherein said annular cylinder of foam rubber is of substantially equal length with said elongated cylinder.

6. An attachment for a bow as recited in claim 1 wherein said shaft has a diameter of 5/16 and a pitch 24 threads per inch.

7. An attachment for a bow as recited in claim 1 wherein said shaft comprises a bolt that is passed through said substantially circular plate.

8. An attachment for a bow as recited in claim 7 wherein said bolt has a diameter of 5/16 inch and 24 threads per inch.

9. An attachment for a bow of the type having a threaded receptacle on a front face thereof comprising in combination:

an elongated cylinder having a characteristic longitudinal axis, an open front end, and a rear end closed by a circular plate disposed substantially perpendicularly to said longitudinal axis;

a spacer positioned behind said circular plate and formed integrally therewith, said spacer having circular cross sections in planes perpendicular to said longitudinal axis with centers of each of said cross sections lying substantially on said longitudinal axis;

a shaft connected to said spacer and formed integrally therewith and extending away from said rear end of said elongated cylinder having a characteristic shaft axis that is substantially coaxial with said longitudinal axis of said cylinder, said shaft being externally threaded to mate with said threaded receptacle; and annular deformable light holding means for supporting a cylindrical light, said light holding means being journaled within said cylinder.

10. An attachment for a bow as recited in claim 9 wherein said annular deformable light holding means comprises an annular cylinder of foam rubber.

11. An attachment for a bow as recited in claim 9 wherein said shaft has a diameter of 5/16 and inch 24 threads per inch.

12. An attachment for a bow as recited in claim 9 wherein said annular deformable light holding means comprises an annular cylinder of a material that is both compressible and deformable.

13. An attachment for a bow as recited in claim 9 wherein said annular deformable light holding means comprises an annular cylinder of foam rubber.

14. An attachment for a bow as recited in claim 13 wherein said annular cylinder of foam rubber is of substantially equal length with said elongated cylinder.

15. An attachment for a bow of the type having a threaded receptacle on a front face thereof comprising in combination:

annular deformable light holding means, having a characteristic longitudinal axis, for supporting a cylindrical light;

a shaft having a characteristic shaft axis in a predetermined relationship with said light holding means so that said shaft axis is substantially coaxial with said longitudinal axis of said light holding means, said shaft being externally threaded to mate with said threaded receptacle; and support means connected to said shaft and in engagement with said light holding means for holding same in said predetermined relationship.

16. An attachment for a bow as recited in claim 15 further comprising a spacer means positioned behind said light holding means and through which said shaft axis passes.

17. An attachment for a bow as recited in claim 15 wherein said annular deformable light holding means comprises an annular cylinder of a material that is both compressible and deformable.

18. An attachment for a bow as recited in claim 15 wherein said annular deformable light holding means comprises an annular cylinder of foam rubber.

19. An attachment for a bow as recited in claim 15 wherein said support means comprises an elongated cylinder having an open front end, and a rear end closed by a substantially circular plate disposed substantially perpendicular to said longitudinal axis.

20. An attachment for a bow as recited in claim 15 wherein said shaft has a diameter of 5/16 and a pitch of 24 threads per inch.

21. An attachment for a bow as recited in claim 19 wherein said shaft comprises a bolt that is passed through said substantially circular plate.

22. An attachment for a bow as recited in claim 21 wherein said bolt has a diameter of 5/16 inch and 24 threads per inch.

* * * * *